United States Patent [19]

Sommer

[11] 4,232,343

[45] Nov. 4, 1980

[54] METHOD AND APPARATUS FOR RECORDING GRAPHIC OR IMAGE INFORMATION BY MEANS OF PUNCTIFORM RECORDING SPOTS

[75] Inventor: Rüediger Sommer, Raisdorf, Fed. Rep. of Germany

[73] Assignee: Dr. Ing. Rudolf Hell GmbH, Fed. Rep. of Germany

[21] Appl. No.: 959,427

[22] Filed: Nov. 13, 1978

[30] Foreign Application Priority Data

Nov. 17, 1977 [DE] Fed. Rep. of Germany ..... 2751326

[51] Int. Cl.[2] ..... B41J 3/10

[52] U.S. Cl. ..... 358/296

[58] Field of Search ..... 358/296, 298, 302, 297, 358/299, 256, 283

[56] References Cited

U.S. PATENT DOCUMENTS 3,646,262 2/1972 Moe ..... 358/298 X 3,983,319 9/1976 Moe et al. ..... 358/283

4,115,816 9/1978 Moe et al. ..... 358/283

*Primary Examiner*—John H. Wolff

*Assistant Examiner*—Donald Mcelheny, Jr.

*Attorney, Agent, or Firm*—Hill, Van Santen, Steadman, Chiara & Simpson

[57] ABSTRACT

A method and apparatus for recording graphic or image information by means of punctiform recording spots which are arranged line-by-line according to a recording grid, or multi-lined within a matrix, whereby at the beginning of a contour proceeding obliquely to the recording direction, the first recording spot is displaced in the direction of the contour when its edge does not coincide with the contour and, in order to improve the end edge of such a contour proceeding obliquely to the recording direction, the recording of the last recording spot may be additionally displaced relative to the preceding recording spot by a retarding in time of the recording of said last spot.

8 Claims, 14 Drawing Figures

| 1/4 pitch steps | full pitch steps | pitch steps |
|---|---|---|
| 1 | 1/4 | |
| 2 | 2/4 | |
| 3 | 3/4 | |
| 4 | 1 | |
| 5 | 1 1/4 | |
| 6 | 1 2/4 | |
| 7 | 1 3/4 | |
| 8 | 2 | |
| 9 | 2 1/4 | |
| 10 | 2 2/4 | |
| 11 | 2 3/4 | |
| 12 | 3 | |
| 13 | 3 1/4 | |
| 14 | 3 2/4 | |
| 15 | 3 3/4 | |
| 16 | 4 | |
| 17 | 4 1/4 | |
| 18 | 4 2/4 | |
| 19 | 2 3/4 | |
| 20 | 3 | |

*Fig. 9a*

METHOD AND APPARATUS FOR RECORDING GRAPHIC OR IMAGE INFORMATION BY MEANS OF PUNCTIFORM RECORDING SPOTS

BACKGROUND OF THE INVENTION

The present invention relates to a method and apparatus for recording graphic or image information by means of punctiform recording spots that are arranged line-by-line according to a recording grid, or multi-lined within a matrix, and the recording effected step by step, with a recording frequency corresponding to the point intervals or pitch of the grid or matrix, and in which at the beginning of a contour proceeding obliquely to the recording direction the first recording spot is displaced in the direction of the contour by at least a fractional pitch step when its edge does not coincide with the contour, and recording the following recording spots step-by-step in the pulse of the recording frequency.

Recording methods are known in which the image or graphic characters are recorded by the formation of covered surfaces arranged in a grid, for example mosaic printers, which operate with needles, thermographic or electric recording combs. Ink jet printers with individual jets or jets arranged in a matrix, which generate punctiform recording spots, operate along the same principle. The individual recording spots are recorded in correspondence with the grid which is dependent upon the recording frequency. In all of these cases, contours running diagonally to the recording direction are reproduced with poor quality, i.e. present a more or less stepped formation. An example of a general system of the type involved, and of stepped configurations is illustrated in German Offenlegungsschrift No. 2,639,856. This could of course be improved by a finer resolution, i.e. increasing the scanning and recording frequency or, effecting a refinement of the scanning and recording grid. This, however, will be associated with a greater cost and, if the recording apparatus will not permit a higher point frequency, with an impairment of the recording. In some of the aforementioned recording methods, this is only possible to a certain degree, as it is not possible to reduce the point size in the recording as greatly as would be desired.

A method as heretofore been proposed for effecting an improvement in the contour without increasing the fineness of the scanning or the scanning frequency. However, this improvement is effected on the first or leading edge occurring in the recording direction but not on the trailing edge. This method has been termed the "fractional step method" and makes it possible, with the same recording frequency, to displace the first point on an edge by a fractional pitch of the screen line distance in the direction of the contour. The subsequently following points are then written with the normal recording frequency which, however, result in the contour being reproduced at its trailing edge in the original stepped formation, i.e. the improvement thus occurred only along the leading edge of the contour.

BRIEF SUMMARY OF THE INVENTION

The present invention therefore has its objective to provide a method and apparatus for effecting an improvement in the fractional step method by means of which the recording at the trailing edge of a contour is also improved.

This is achieved in the present invention by displacing the first recording spot, at the beginning of the contour proceeding obliquely to the recording direction, in the direction of the contour by at least a fractional pitch when its edge does not coincide with the contour, as in the known method above referred to, with the subsequently following recording spots being recorded step-by-step in the pulse of the recording frequency until the last recording step, which is then displaced in the direction of the contour an additional amount, thereby reducing the stepped effect and providing an improvement in the edge of such a contour.

Apparatus for practicing the method is also provided. In the exemplary embodiment illustrated, the information to be recorded, in quantized form and its length determined in terms of multiplies of the point interval or pitch utlizing a pulse frequency which is a multiple of the recording or step frequency and thus represents a predetermined fraction of the pitch interval. In the event the video segment is not an even multiple of the pitch interval, the control signal is formed which controls the formation of the final output signal.

BRIEF DESCRIPTION OF THE DRAWINGS

In the drawings wherein like reference characters indicate like or corresponding parts:

FIG. 9*a* illustrates a variation of FIG. 9;

DETAILED DESCRIPTION OF THE INVENTION

Figure 1:
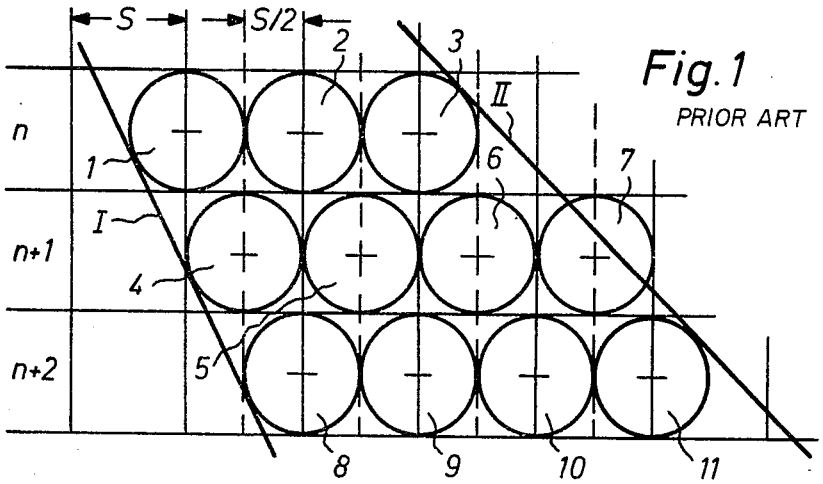
Fig. 1 PRIOR ART
FIG. 1 represents a point arrangement of a obliquely proceeding black line, with the application of the usual fractional pitch method.

Referring to the drawings and more particularly to FIG. 1, there is illustrated therein a portion of a contour which is defined by means of lines I and II, which contour comprises the recording points 1 through 11. Lines n, n+1, and n+2 are illustrated in vertical direction, and respective half pitch steps of the grid points are illustrated in horizontal direction. It will be apparent that in line n+1, in which the half pitch method has been employed, the contour proceeding along the boundary or edge line I has been accurately and cleanly depicted. However, it will be noted that at the end of such line the edge-defining line II has been crossed and a "hole" has resulted between the preceding line, which produces a stepped formation of the contour.

Figure 2:
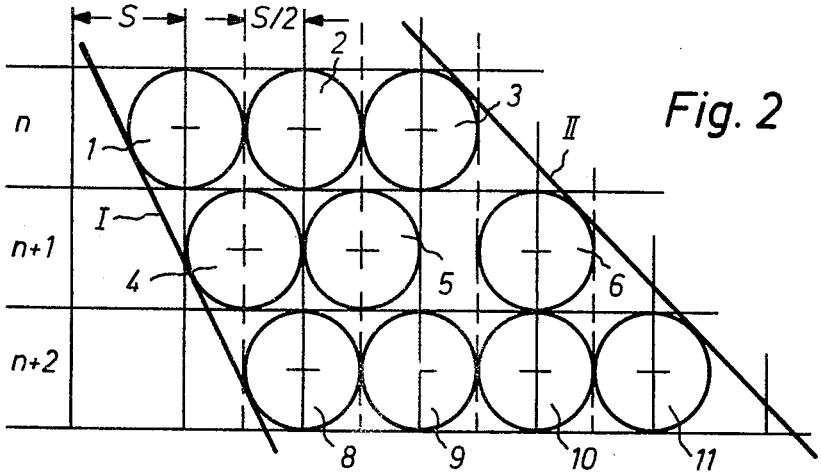
FIG. 2 illustrates a point arrangement of a corresponding obliquely proceeding black line with the application of the present invention thereto for improving the trailing edge thereof.
Figure 3:
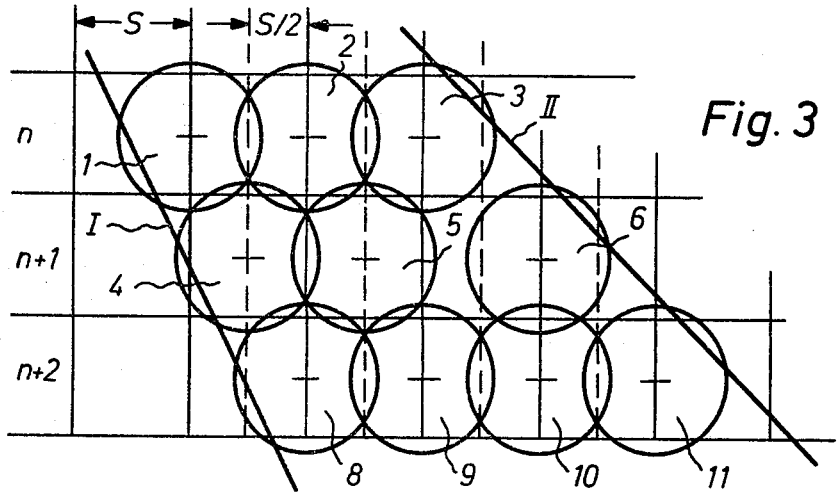
FIG. 3 is a point arrangement corresponding to FIG. 2 but in which an overlapping of spots has been employed.

FIG. 2 generally illustrates the sample example. However, in line n+1, the last grid point is displaced by a half pitch step in the direction of the contour, i.e. to the right as viewed in FIG. 2, which, in contrast to the usual recording method, does not involve an increased scanning frequency. As hereinafter subsequently explained, this displacement of the grid point is relatively easy to achieve, by effecting a retarding of the recording thereof sufficient to displace the recording spot by a half pitch step during the recording operation. While there still remains small gaps along the boundary line II between the lines n and n+1, as well as between the n+1 and n+2, these will normally be suppressed in the usual recording operation in which a very strong or large overlapping of grid points are utilized. Such overlapping is disclosed, for example in German Offenlegungsschrift No. 2,616,397. This result is illustrated in FIG. 3 and it will be clearly apparent that a more gap-free contour edge is also achieved at the boundary line II.

Figure 4:
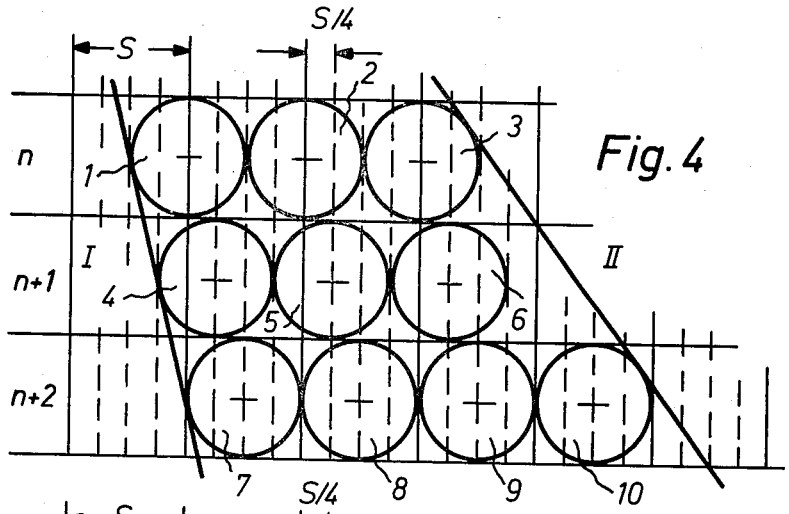
FIG. 4 is a similar point arrangement illustrating the application of the quarter pitch method thereto.

FIG. 4 illustrates an example of a contour such as illustrated in FIG. 1, likewise defined by the border or edge defining lines I and II, in which the known quarter pitch method is utilized and, as will be apparent, the contour at line I is better reproduced but there is still a gap present in line n+1 of the contour at the edge defining line II.

Figure 5:
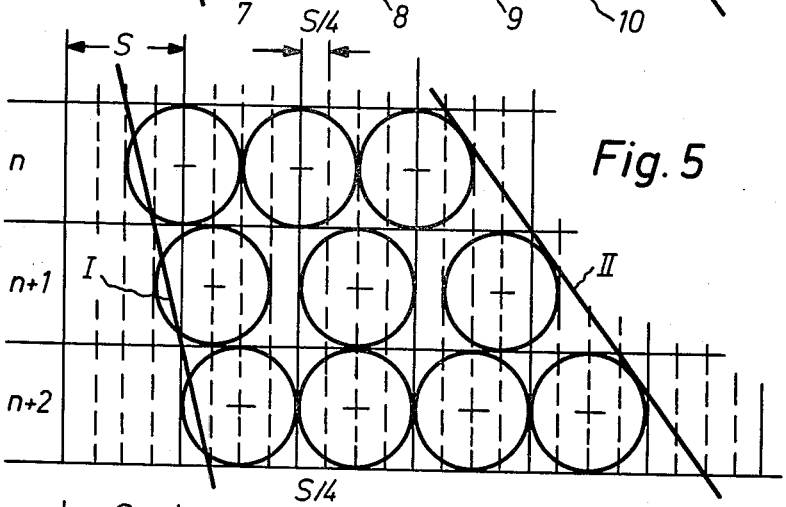
FIG. 5 is a point arrangement according to FIG. 4, in which additional improvement of the trailing edge is effected in accordance with the invention.

FIG. 5 also illustrates the use of the quarter pitch method in conjunction with the present invention, in which a stepped configuration at the trailing edge is avoided, and, in addition, the three recording spots are distributed on the quarter pitch steps available in the line to provide a uniform distribution or spot spacing along the line n+1. The contour is thus optimally reproduced along both the edge line I as well as the edge line II.

Figure 6:
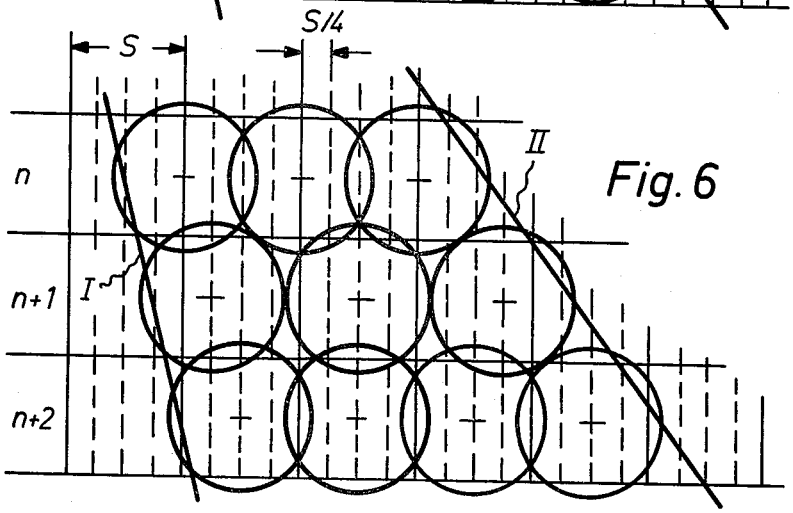
FIG. 6 illustrates a point arrangement according to FIG. 5, in which an overlapping of the recording points is employed.

FIG. 6 depicts the embodiment of FIG. 5, utilizing the additional overlapping of the grid points or recording spots. As will be apparent the individual recording spots almost completely disappear, so that a nearly ideal representation is achieved of the contour defined by the lines I and II. If a larger overlapping is utilized, the intermediate spaces will disappear entirely.

Figure 7:
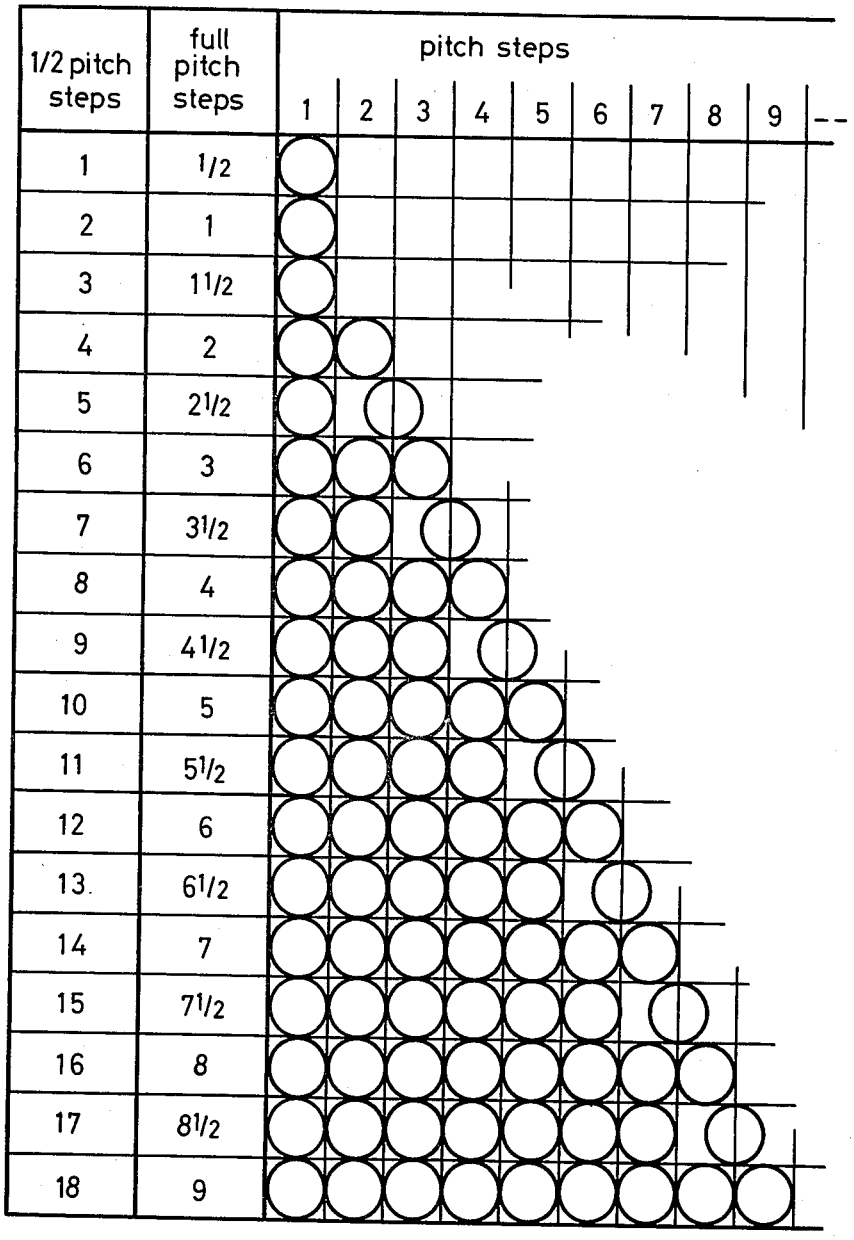
FIG. 7 illustrates various line widths, utilizing a half pitch step, in the fractional pitch method in accordance with the invention.

FIG. 7, illustrates, in chart form, the formation of line widths involving a larger number of grid points, illustrating the application of the invention to the half pitch method. Where the line lengths involve even multiples of full pitch steps, the grid points connect closely to one another, and only in the case where a line length involves a half pitch step, does a gap arise by reason of the retardation of the recording of the last grid point. However, it will be apparent that with suitable overlapping, such gap presents no problem as has been noted from the arrangement in FIG. 6.

Figure 8:
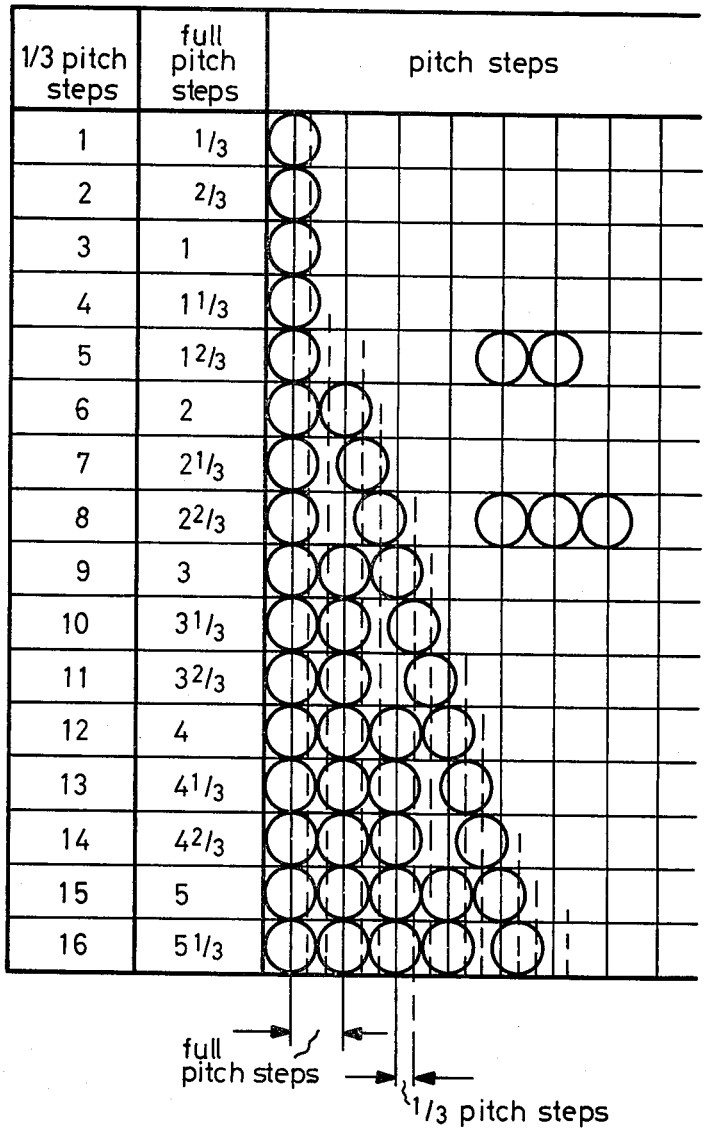
FIG. 8 is a similar illustration of various line widths utilizing the invention with the fractional pitch method utilizing a one-third pitch step.

FIG. 8 illustrates the basic format utilizing one-third pitch steps. In this arrangement, it will be noted that where five or eight pitch steps are involved, alternative formations are possible. Thus, in the case of five $\frac{1}{3}$ pitch steps, one grid point or two grid points may be employed, while in the case of eight $\frac{1}{3}$ pitch steps, three grid points may be utilized instead of one.

Figure 9:
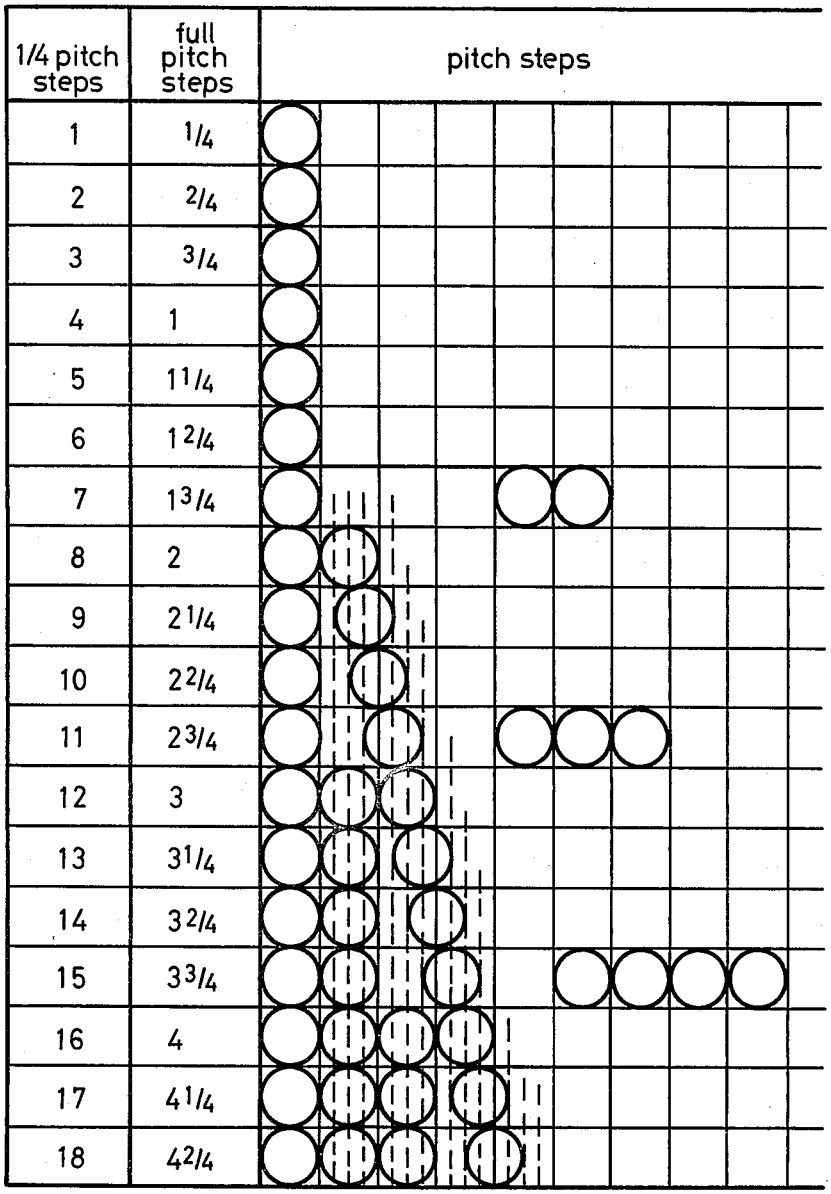
FIG. 9 is an illustration of various line widths utilizing the fractional pitch method with a one quarter pitch step.

It will be appreciated that the number of variations in the individual transitions become greater as the number of fractional pitch steps increases, as will be apparent from reference to FIG. 9, illustrating the use of $\frac{1}{4}$ pitch steps. Thus, in the case of seven $\frac{1}{4}$ pitch steps, two possibilities again arise of utilizing of either two or three grid points. Likewise, in the case of eleven $\frac{1}{4}$ pitch steps, a choice is presented of utilizing either two or three grid points, and similarly in the case of fifteen $\frac{1}{4}$ pitch steps, three or four grid points may be employed. This law of formation proceeds according to a specific plurality of fractional pitch steps, in the last example, all four fractional pitch steps. Which solution is employed is to a large extent dependent upon whether a large or a small overlapping is utilized. In most instances, where overlapping is involved, it will be desirable to employ the lower number of grid points.

FIG. 9*a* illustrates an example similar to FIG. 9, again utilizing a $\frac{1}{4}$ pitch steps in which a distribution may be effected of the gaps in the interior of the graphic line to be written. For example, beginning with the fourteenth and fifteenth pitch steps as well as the eighteenth and nineteenth steps, the gap may be distributed between several pairs of recording spots.

Figure 10:
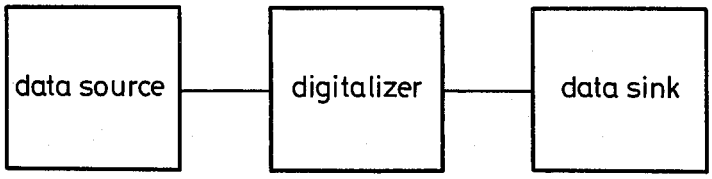
FIG. 10 is a block diagram of the invention.

FIG. 10 illustrates in block form the basic design of a circuit which is suitable for the practice of the invention. It comprises a data source, which repesents a scanning system that is described in greater detail in FIG. 11, a digitalizer, and a data sink.

Figure 11:
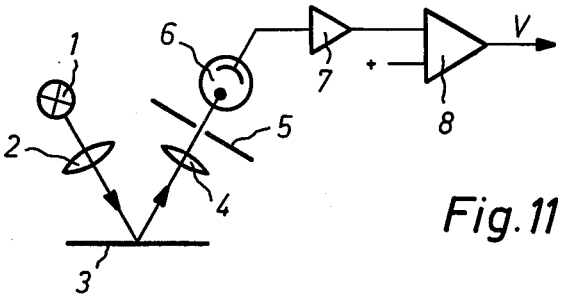
FIG. 11 is a block diagram for a scanning installation.

FIG. 11 schematically illustrates an arrangement for scanning the original from which the recording is to be made. It comprises a light source 1, and an optical system 2, by means of which the light source is focused on a schematically illustrated original 3. The light reflected therefrom is supplied over a collector lens 4, and an aperture 5 to an optoelectric transducer 6, whose output signal is supplied, over an amplifier 7, to a comparator 8, which converts the signal delivered from the optoelectric transducer into a video signal V, which is temporally analog and quantized black/white in its amplitude. This signal is illustrated in line b of FIG. 13.

Figure 12:
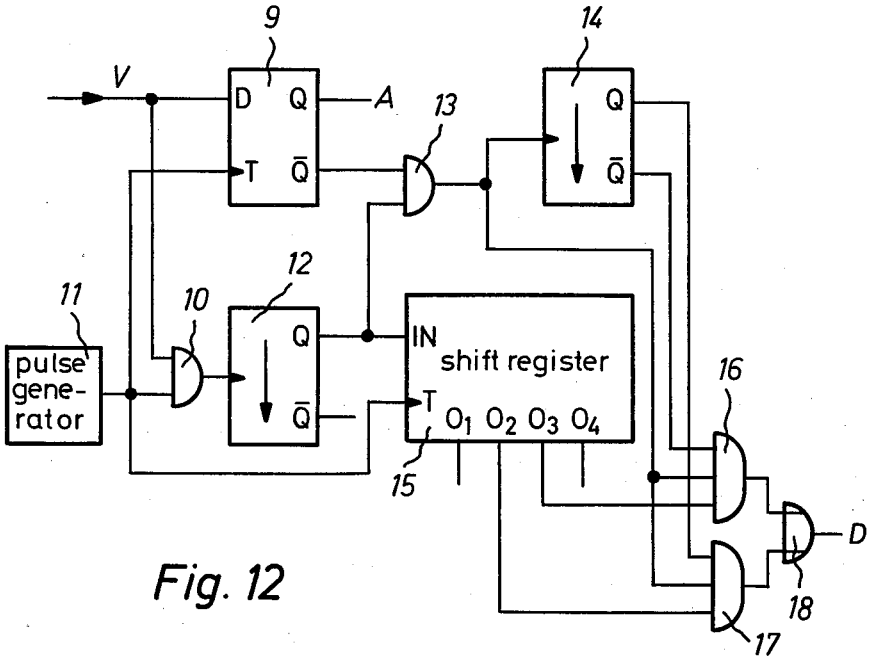
FIG. 12 represents schematically an exemplary electronic circuit for the invention.

As illustrated in FIG. 12, the input signal V is supplied to the D-input of a D-flip-flop 9 and to one input of an AND-gate 10. The output of a pulse generator 11, having a pulse frequency corresponding to a one-half pitch step, has its output connected to the T input of the flip-flop 9 and to the second input of the gate 10, the output of which is connected to the trigger input of a monostable flip-flop 12. The $\overline{Q}$ output of the flip-flop 9 is supplied to one input of an AND-gate 13, the output of which is supplied to the trigger input of a second monostable flip-flop 14.

The Q output of the monostable flip-flop 12 is supplied to the second input of the gate 13 and to the input IN of a shift register 15, the T input of which is supplied with pulses from the generator 11.

The outputs 03 and 02, respectively representing a retarding of the input signal by three or two pulse steps, are supplied to respective inputs of AND gates 16 and 17, each of which has a second input connected to the output of the gate 13, with the Q output of the flip-flop 14 being supplied to a third input of the gate 17 and the $\overline{Q}$ output of the flip-flop supplied to a third input of the gate 16. The output of the respective gates 16 and 17 are supplied to an output D over a suitable OR-gate 18.

In operation, the video input signal V is temporarily quantized in the flip-flop 9 by means of the pulses of the pulse generator 11, so that a video signal A (line c, FIG. 13) is produced at the output Q and $\bar{Q}$ of the flip-flop. The first of the video pulses A has an exact length of five and one-half full pitch steps (two half-steps or pulses of the pulse generator 11), so that without employment of the invention, the problem of a stepping of the trailing edge would occur. In the case of the second pulse thereof, the length of the pulse is exactly a whole multiple, i.e. four full pitch steps. In accordance with the invention, this is also reproduced as four full pitch steps. Upon coincidence between the video signal V (line b) and the pulse of the pulse generator 11 (line a) an output pulse signal will appear at the output of the gate 10, causing the monostable flip-flop 12 to trigger. The monostable flip-flop 12 is so adjusted that its duration in flipped state is somewhat smaller than an entire full pitch step, so that the output signal will correspond to the form illustrated in line d of FIG. 13.

When the signal at the output of the flip-flop 9 (line c) is not an even multiple of a full pitch step, a control signal will appear at the output of gate 13 (line g of FIG. 13) which signal is applied to the trigger input of the flip-flop 14 and to respective inputs of gates 16 and 17.

Figure 13:
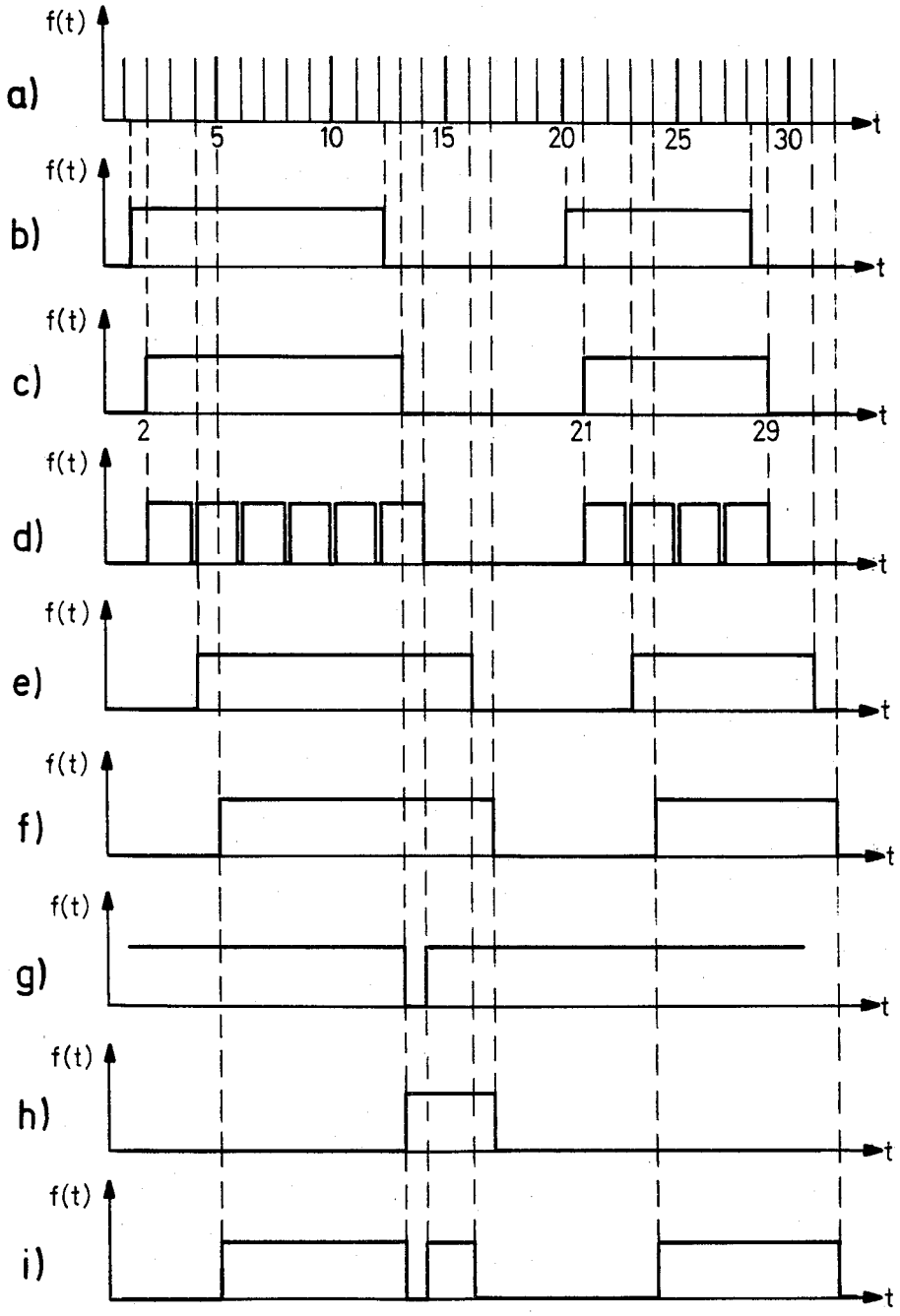
FIG. 13, consisting of a–i, illustrates pulse diagrams for the circuit of FIG. 12.

The output of the monostable flip-flop 12 is additionally applied to a input of a shift register 15, by means of which, in conjunction with the pulses supplied thereto by the pulse generator 11 (line a), a retarding is effected of two half pitch steps or three half pitch steps which respectively appear at the output 02 and 03, such retarded signals are respectively illustrated in lines e and f of FIG. 13. These two signals being selectively supplied over the gates 16 and 17 and OR-gate 18, to the output D, whose signal is illustrated in line i of FIG. 13. The output pulse of gate 13 illustrated in FIG. 13*g* is prolonged by means of the monostable flip-flop 14 for a duration of about four half pitch steps, i.e. four pulse periods, as will be apparent from a reference to line h of FIG. 13.

The output signals of gate 13 and the flip-flop 14 control the change over of the retarded signals supplied by the shift register 15 (lines e and f) to the output D. When the signal illustrated in line h of FIG. 13 is equal to a logic zero, the signal is supplied to the output D in accordance with line f of FIG. 13 and likewise, when such signal is equal to a logic one, the signal is supplied to the output D in accordance with line e of FIG. 13.

However, it is also possible that the output signal of gate 13 is a logic zero, in which event neither of the signals of lines e or f are supplied to the output D, but instead a logic zero exists thereat.

As a result, video signals with a length consist of exact multiples of full pitch steps arrive at the output retarded by three half-pitch steps or periods. However, in the event the video signal length, as illustrated in Example 13, does not amount to an exact multiple of a full-pitch step, an interval of a half full-pitch step is produced between the last full-pitch step recorded and the next full-pitch step. In the example, the total length of such video signal at output D likewise amounts to five and one half full-pitch steps as in the video signal depicted on line c of FIG. 13. As a result the last full pitch step of such video signal corresponds to the signal depicted on line i of FIG. 13, i.e. it thereby conforms to the trailing edge of the contour being reproduced. It will be appreciated that the invention is not limited to the use of one half or one quarter pitch step, but that the full pitch step can be subdivided as finely as desired. Thus, the finer the subdivision, the more precisely the recording spots can be placed on the contours, whereby the cost outlay is dependent upon the quality required, i.e. determined by the fineness of the subdivision to be utilized.

Although I have described my invention by reference to particular illustrative embodiments, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim as my invention:

1. An apparatus for recording graphic or image information derived from a video signal source by means of punctiform recording spots that are arranged, line-by-line according to a recording grid or multi-lined within a matrix, and the recording effected, step-by-step, with a recording frequency corresponding to the fixed point intervals or pitch of the grid or matrix, comprising (a) means, including a pulse generator having a frequency of a fraction of said recording frequency and representing fractional pitch-steps, (b) means connected to said video signal source and the pulse generator for quantizing said video signal with respect to such pulses, (c) means connected to said video signal source and the pulse generator for producing a series of pulses, the duration of each pulse being approximately equal to the duration of a full pitch step, (d) means connected to said means for producing a series of pulses and said means for quantizing the video signal for producing a control signal when the quantized video signal has a duration less than even multiple of a full pitch step, (e) means connected to said means for producing a series of pulses, for retarding said series of pulses a first predetermined number of fractional pitch steps and for retarding said series of pulses a second predetermined greater number of fractional pitch steps, (f) means connected to said means for producing a control signal, for retarding said control signal with said greater number of fractional pitch steps and for inverting said retarded control signal, (g) an output for generating the recording signal for the punctiform recording and (h) means connected to said output and said means for retarding and inverting the control signal and said means for retarding said series of pulses for supplying to said output as recording signals either the series of pulses, retarded with said second greater number of fractional pitch steps if no control signal is generated by said means for generating the control signal or the series of pulses retarded with said second greater number of fractional pitch steps without the last pulse of said series and with an additional pulse retarded with one fractional pitch step.

2. An apparatus according to claim 1, wherein said means for producing said pulses of approximately one full pitch step comprises a monostable flip-flop, having a triggered duration slightly less than one full pitch step, which is triggered by means responsive to coincidence of the video signal and pulses of said generator.

3. An apparatus according to claim 1, wherein said quantizing means comprises a D-flip-flop having said video signal supplied to the D-input and the pulses of said generator to the T input thereof.

4. An apparatus according to claim 1, wherein said means for retarding said video signals comprises a shift register supplying respective retarded signals at corresponding outputs thereof.

5. An apparatus according to claim 4, wherein said means for retarding said control signal comprises a monostable flip-flop having a triggered duration equal to the desired retardation.

6. An apparatus according to claim 5, wherein said means responsive to said control signals comprise respective AND-gates having therein outputs connected to respective inputs of an OR-gate, the output of the latter forming said output, each AND-gate having an input connected to a respective output of said shift register and a second input connected to the output of said control signal producing means, a third input connected to a respective output of said control signal retarding flip-flop.

7. An apparatus according to claim 6, wherein said means for producing said pulses of approximately one full pitch step comprises a monostable flip-flop, having a triggered duration slightly less than one full pitch step, which is triggered by means responsive to coincidence of the video signal and pulses of said generator.

8. An apparatus according to claim 7, wherein said quantizing means comprises a D-flip-flop having said video signal supplied to the D-input and the pulses of said generator to the T input thereof.

* * * * *